US010696447B2

(12) United States Patent
Block

(10) Patent No.: US 10,696,447 B2
(45) Date of Patent: Jun. 30, 2020

(54) SHIPPING AND DISPLAY CARTON, BLANK AND ASSOCIATED METHOD

(71) Applicant: The C.W. Zumbiel Company, Hebron, KY (US)

(72) Inventor: Steven J. Block, Amelia, OH (US)

(73) Assignee: The C.W. Zumbiel Company, Hebron, KY (US)

( * ) Notice: Subject to any disclaimer, the term of this patent is extended or adjusted under 35 U.S.C. 154(b) by 0 days.

(21) Appl. No.: 16/407,213

(22) Filed: May 9, 2019

(65) Prior Publication Data

US 2019/0344925 A1 Nov. 14, 2019

Related U.S. Application Data

(60) Provisional application No. 62/669,610, filed on May 10, 2018.

(51) Int. Cl.

| | |
|---|---|
| ***B65D 5/54*** | (2006.01) |
| ***B65D 5/02*** | (2006.01) |
| ***B65D 5/52*** | (2006.01) |
| ***A47F 5/11*** | (2006.01) |
| ***B65D 17/353*** | (2006.01) |
| ***B65D 17/00*** | (2006.01) |
| ***B65D 5/16*** | (2006.01) |
| ***B65D 25/00*** | (2006.01) |

(52) U.S. Cl.

CPC ..... *B65D 5/5445* (2013.01); *A47F 5/11* (2013.01); *B65D 5/0227* (2013.01); *B65D 5/16* (2013.01); *B65D 5/52* (2013.01); *B65D 5/542* (2013.01); *B65D 17/04* (2013.01); *B65D 17/353* (2018.01); *B65D 25/005* (2013.01); *B65D 2517/0002* (2013.01)

(58) Field of Classification Search

CPC .. B65D 5/5445; B65D 17/353; B65D 5/0227; B65D 5/16; B65D 5/52; B65D 5/542; B65D 17/04; B65D 25/005; B65D 5/54; B65D 2571/0058; A47F 5/11

USPC ..... 229/235, 242, 164, 240, 103, 120.08, 229/120.18, 120.12, 120.23, 238, 241; 206/736, 774, 738, 746

See application file for complete search history.

(56) References Cited

U.S. PATENT DOCUMENTS

| | | | | |
|---|---|---|---|---|
| 3,669,251 A * | 6/1972 | Phillips, Jr. | ..... | B65D 5/5007 206/756 |
| 3,786,914 A | 1/1974 | Beutler | | |
| 4,113,100 A * | 9/1978 | Soja | ..... | B65D 5/5445 229/112 |
| 4,905,837 A * | 3/1990 | Schuster | ..... | B65D 5/5475 229/120.011 |

(Continued)

*Primary Examiner* — Christopher R Demeree

(74) *Attorney, Agent, or Firm* — Wood Herron & Evans LLP

(57) ABSTRACT

A combination shipping carton and display stand contains a number of items such as pouches, bags, containers or products to be displayed for retail sale, distribution or other purposes. The carton serves as a shipping container for transport and/or storage of the products. When the products are to be displayed for retail sale or distribution, an upper shipping portion of the carton is removed by tear strips to expose the products in a display stand. The products are arranged and maintained in an orderly fashion by a pair of wedges inside of the carton and formed by the carton material to cant the products for enhanced display to the consumer.

23 Claims, 9 Drawing Sheets

(56) References Cited

U.S. PATENT DOCUMENTS

| | | | | |
|---|---|---|---|---|
| 5,167,324 | A * | 12/1992 | Miller | B65D 5/48014 206/738 |
| 6,371,365 | B1 | 4/2002 | Doucette et al. | |
| 6,386,366 | B1 | 5/2002 | Friedman | |
| 6,974,028 | B2 | 12/2005 | Ford et al. | |
| 7,992,716 | B2 | 8/2011 | Jackson | |
| 8,342,335 | B2 * | 1/2013 | Couture | B65D 5/5445 206/746 |
| 8,840,011 | B2 | 9/2014 | Kohler | |
| 2013/0105355 | A1 * | 5/2013 | Keefe | B65D 5/5445 206/736 |

* cited by examiner

SHIPPING AND DISPLAY CARTON, BLANK AND ASSOCIATED METHOD

This claims the benefit of U.S. Provisional Patent Application Ser. No. 62/669,610, filed May 10, 2018 and hereby incorporated by reference in its entirety.

BACKGROUND OF THE INVENTION

This invention relates generally to a carton for shipping and storage as well as support and display of a product in the carton, including a packaged food product. More particularly, this invention relates to a carton, carton blank and method of forming a carton which, in a first configuration, facilitates shipping and storage of products positioned within the carton and, in a second configuration, facilitates support and display of the products for consumer purchase.

Cartons generally, including paperboard cartons or boxes, have been used for many years to transport and store individual products including, for example, packaged food products such as cereals, snack foods, dried fruit products, etc. Several individually packaged products are generally packed within a single paperboard box which is provided with a removable portion which is initially mated to the remainder of the box for shipping and/or storage. The products are generally transported within the closed or sealed carton from a manufacturing facility to a place of retail sale. To present the products for retail sale, store personnel must first remove the lid or open the sealed top, remove each individual product from the box, properly position each individually product on available display shelves, and finally discard the box. Thus, transporting products from a manufacturing facility to a storage location and then to a display location using conventional paperboard cartons or boxes is a labor-intensive process.

To address at least some of these inefficiencies, commonly a shipping/storage carton is also used to display the products therein for retail sale. After the carton is shipped, it is opened and the products loaded therein can be positioned in a display stand portion of the carton at a display location. However, after the carton is shipped and opened, the contents have often shifted and appear disorganized. After it is opened, many prior art cartons no longer provide adequate support for the products. For example, if the products are packaged as individual bags or soft-side packages, the carton does not provide adequate support for the packaged products. The packaged products, therefore, can easily fall or shift. Consequently, after the carton is opened and positioned in a display location, the products loaded therein are disorganized which results in a product display which is generally disorganized, unappealing and unattractive to a consumer. Store personnel must re-organize and arrange the products which is very labor intensive and inefficient.

Accordingly, a need exists for a carton which facilitates shipping and storage of a products as well as support and proper display of the products for consumer purchase, distribution or display.

SUMMARY OF THE INVENTION

These and other objects of the invention have been attained by a combination shipping carton and display stand containing a number of items such as pouches, bags, containers or products to be displayed for retail sale, distribution or other purposes. The carton serves as a shipping container for transport and/or storage of the products. When the products are to be displayed for retail sale or distribution, an upper shipping portion of the carton is removed by tear strips to expose the products in a display stand.

The products are arranged and maintained in an orderly fashion by a pair of wedges inside of the carton and formed by the carton material to cant the products for enhanced display to the consumer. A bottom wedge cooperates with a top wedge formed within the carton to stabilize and position the products in a slanted orientation in the resulting display stand for enhanced presentation and viewing by the consumer in an orderly and organized fashion with each of the products maintained in the slanted orientation even as the initial products are removed from the display stand portion of the carton according to various embodiments of this invention. The top wedge is removed from the carton along with a shipping portion of the carton and the bottom wedge remains in the display stand to cant the products therein.

In various embodiments, the invention includes a carton, a blank to form the carton, a method of forming the blank into a carton, a package of products contained in the carton and products displayed in a display stand portion of the carton.

BRIEF DESCRIPTION OF THE DRAWINGS

The above-mentioned and other features and advantages of this invention, and the manner of attaining them, will become more apparent and the invention itself will be better understood by reference to the following description of embodiments of the invention taken in conjunction with the accompanying drawings, wherein.

DETAILED DESCRIPTION OF THE INVENTION

Figure 1:
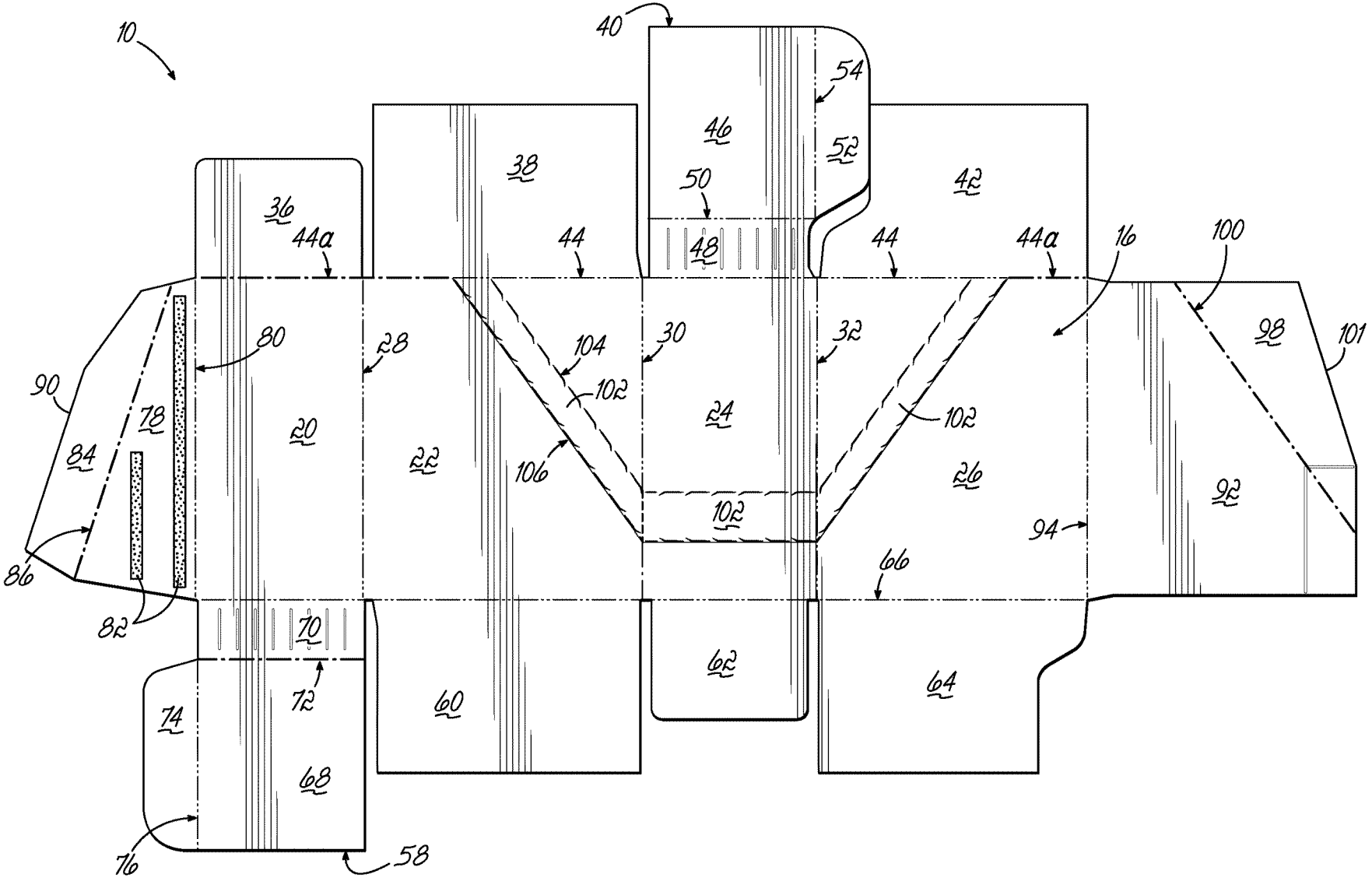
FIG. 1 is a plan view of a print side of a carton blank according to one embodiment of this invention.
Figure 5:
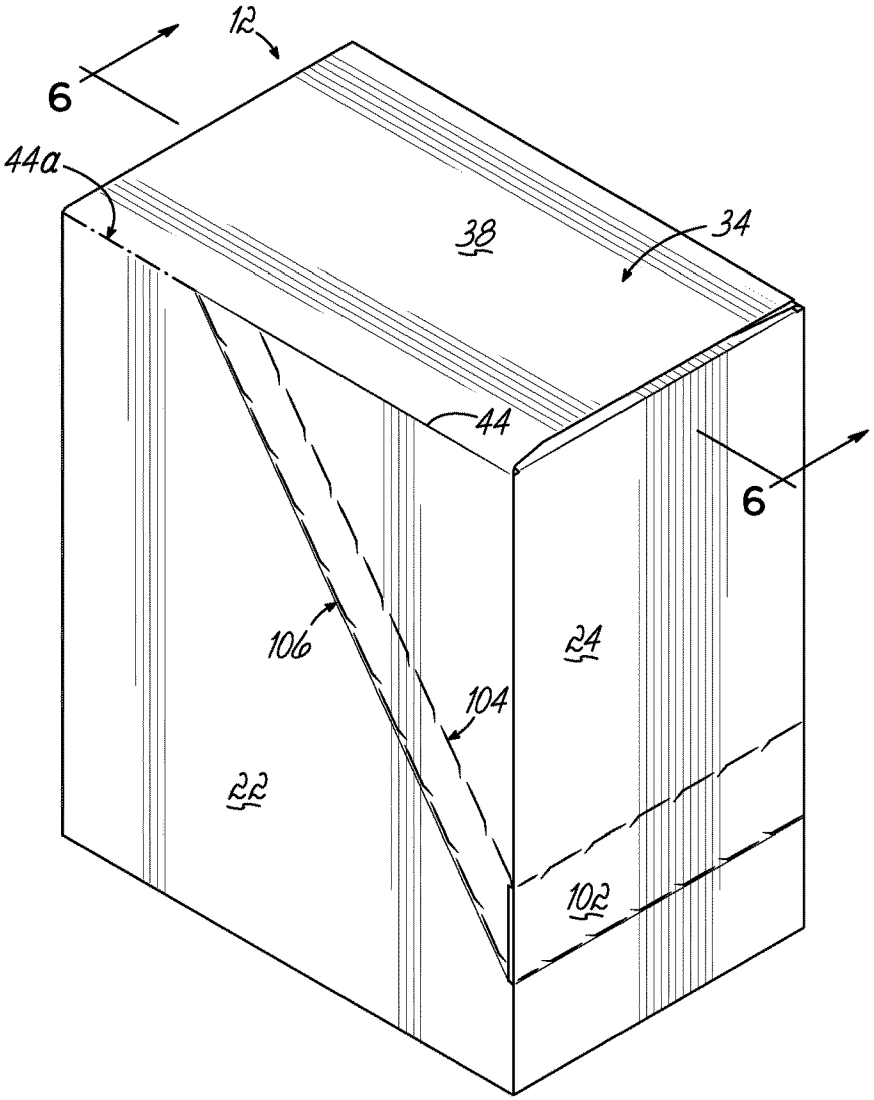
FIG. 5 is a perspective view of an erected carton according to one embodiment of this invention.

An embodiment of a carton blank 10 according to this invention is shown in FIG. 1. The carton blank 10 is folded according to another aspect of this invention to form a shipping and display carton 12 which, according to one embodiment, is shown in FIG. 5. The carton 12 is intended to contain a number of products 14, each of which may be individually packaged according to various embodiments of this invention.

Figure 2A:
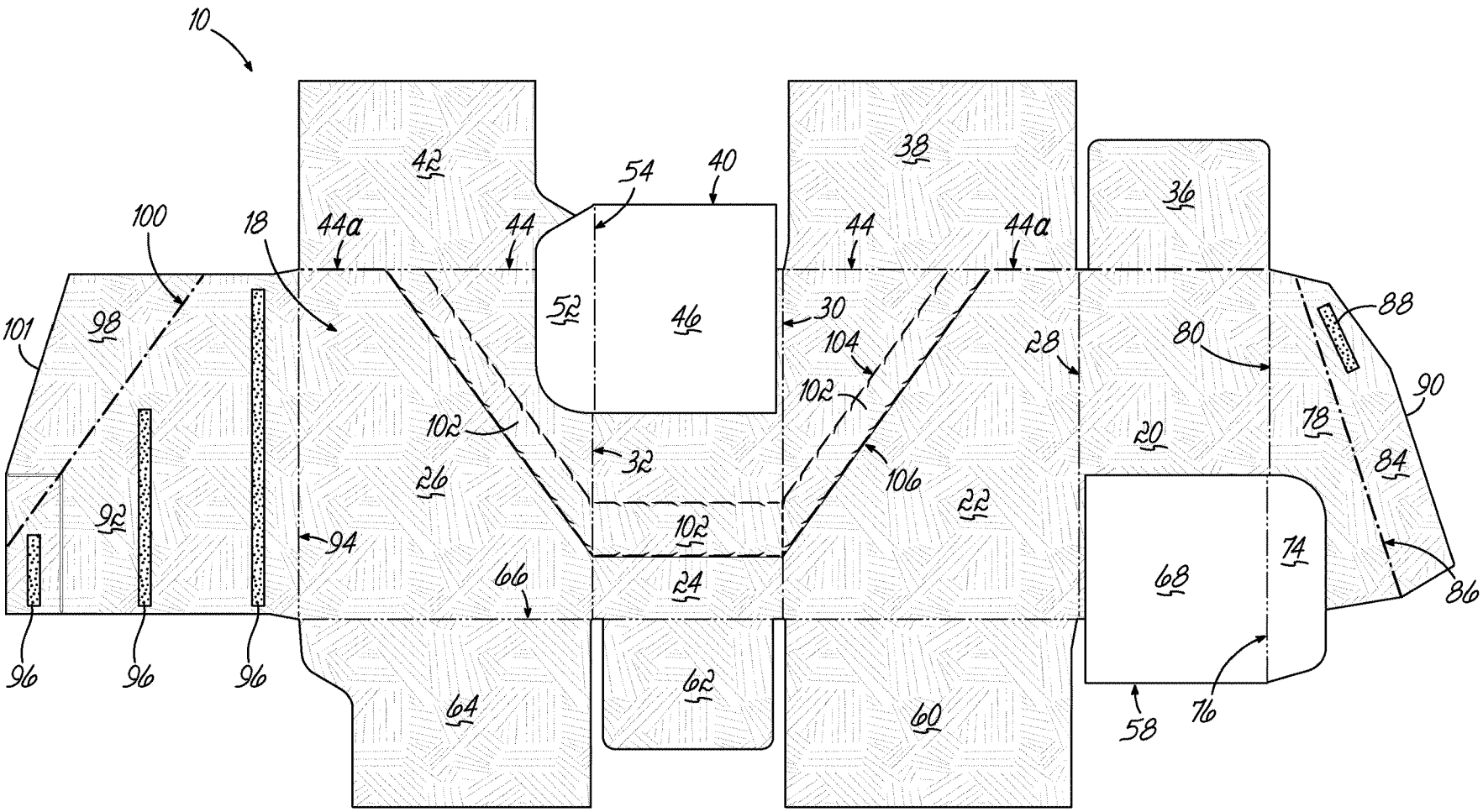
FIG. 2A is a plan view of the non-print side of the carton blank of FIG. 1 with selected flaps folded onto the non-print side of the blank to expose the print side of those flaps.
Figure 2B:
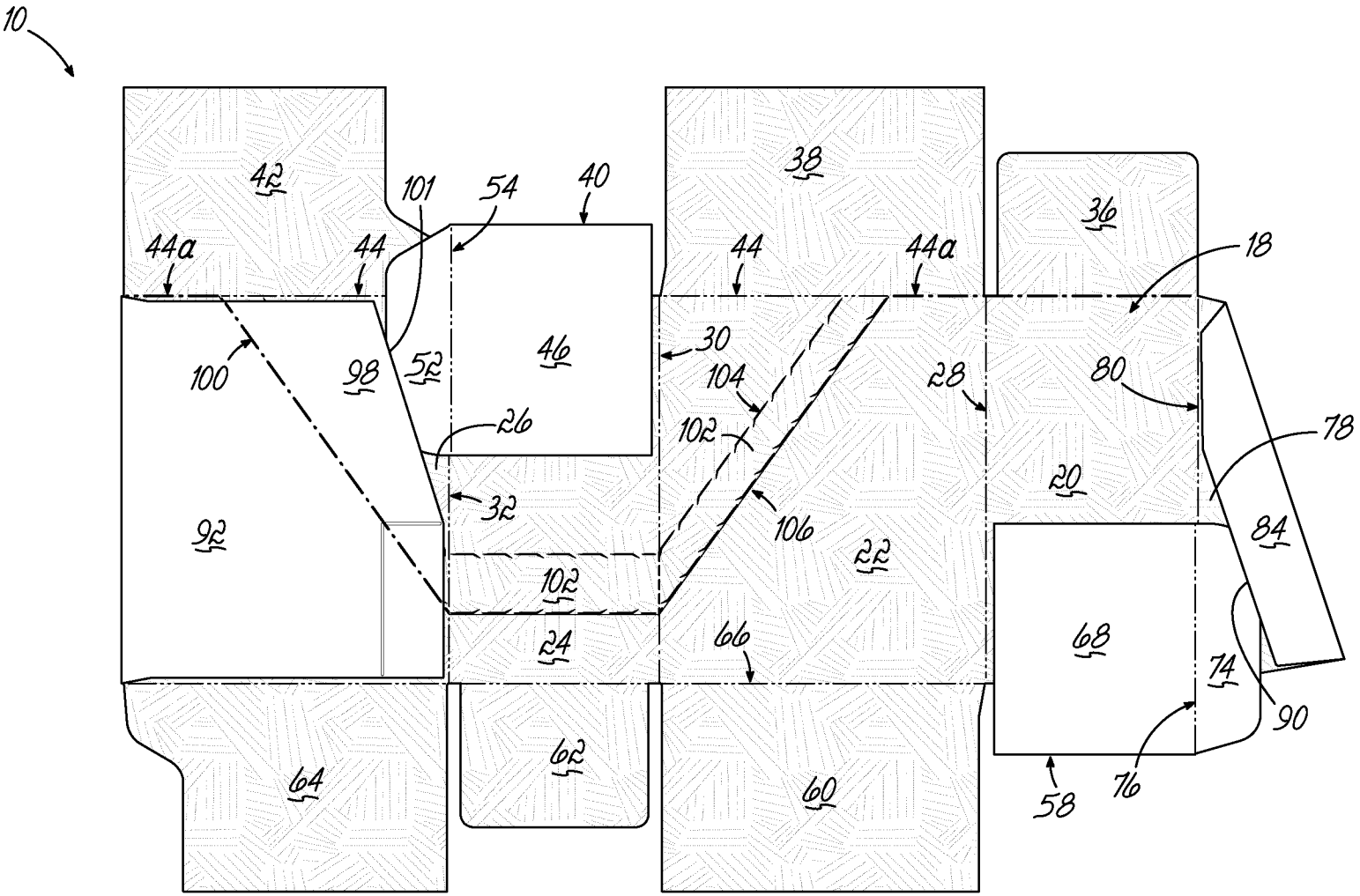
FIG. 2B is a view similar to FIG. 2A with additional flaps folded onto the non-print side of the blank to expose the print side of those additional flaps.

The carton blank 10 of FIG. 1 is shown with the print side 16 facing upwardly. The carton blank 10 is also shown in FIG. 2A-2B with the non-print side 18 facing upwardly. The carton blank 10 includes a number of serially connected panels including a back panel 20, a first side panel 22, a front panel 24 and a second side panel 26. These panels are serially connected one to another by panel fold lines 28, 30, 32. A top 34 of the carton 12 is formed by a number of flaps which are foldably connected to the panels.

Specifically, a back panel top flap 36 is foldably connected to the back panel 20, a first side panel top flap 38 is foldably connected to the first side panel 22, a front panel top flap 40 is foldably connected to the front panel 24 and a second side panel top flap 42 is foldably connected to the second side panel 26. These top flaps 36, 38, 40, 42 are foldably connected to the associated panel by a fold line 44. A portion 44*a* of the fold line 44 which joins the first side panel top flap 38, the second side panel top flap 42 and the back panel top flap 36 is a combination fold line and score line which may be torn to separate the respective flaps from the associated panels as will be described later herein.

The front panel top flap 40 includes three portions. Specifically, a top wedge face flap 46 is on a distal portion of the front panel top flap 40 and is joined to the front panel 24 by a top wedge cap flap 48 via a fold line 50. A top wedge positioning flap 52 is foldably connected to one lateral side edge of the top wedge face flap 46 by a fold line 54. The top wedge face flap 46 and top wedge cap flap 48 are serially connected via respective fold lines 50, 44 to the front panel 24 as shown in FIG. 1.

A bottom 56 of the carton 12 is also formed by a combination of flaps, each of which are foldably connected to the panels of the carton 12. Specifically, a back panel bottom flap 58 is foldably connected to the bottom of the back panel 20, a first side panel bottom flap 60 is foldably connected to the first side panel 22, a front panel bottom flap 62 is foldably connected to the front panel 24 and a second side panel bottom flap 64 is foldably connected to the second side panel 26. These bottom flaps 58, 60, 62, 64 are foldably connected to the associated panels by a fold line 66 extending longitudinally along the bottom of the carton blank 10 as shown in FIG. 1. The back panel bottom flap 58 has three portions including a bottom wedge face flap 68 on the distal end of the back panel bottom flap 58 and a bottom wedge base flap 70 interposed between the bottom wedge face flap 68 and the back panel 20 with a fold line 72 joining it to the bottom wedge face flap 68. A bottom wedge positioning flap 74 is foldably joined to a lateral side of the bottom wedge face flap 68 by a fold line 76 as shown in FIG. 1.

A back panel side glue flap 78 is foldably connected by fold line 80 to a lateral side edge of the back panel 20 and includes one or more deposits of adhesive 82 thereon on the print side 16 of the carton blank 10. A bottom wedge retention flap 84 is foldably connected to the lateral edge of the back panel side glue flap 78 by a fold line 86. A deposit of adhesive 88 is located on the non-print side 18 of the bottom wedge retention flap 84 (FIG. 2A). The peripheral edge of the bottom wedge retention flap 84 includes an edge portion 90 which will be described in more detail later herein.

A second side panel side glue flap 92 is foldably connected to the lateral side edge of the second side panel 26 by a fold line 94. One or more deposits of adhesive 96 are positioned on the non-print side 18 of the carton blank 10 on the second side panel side glue flap 92 (FIG. 2A). A top wedge retention flap 98 is foldably connected to the second side panel side glue flap 92 along a combination fold and score line 100 as shown in FIGS. 1 and 2. The peripheral edge of the top wedge retention flap 98 includes a beveled edge portion 101 which will be described in further detail later herein.

The carton blank 10 according to this embodiment of the invention also includes a tear strip 102 defined, in part, two spaced tear lines 104, 106. Specifically, an upper tear line 104 extends from the juncture of the first side panel top flap 38 and the first side panel 22 at an angle across the first side panel 22 to the juncture between the first side panel 22 and the front panel 24. A parallel lower tear line 106 also extends in the first side panel 22 a spaced distance from the upper tear line 104. The two tear lines 104, 106 then extend in a parallel fashion across the front panel 24 generally parallel to the fold line 66 joining the flaps 62 to the front panel 24. The tear lines 104, 106 then extend in a parallel manner at an angle across the second side panel 26 to the juncture of the second side panel 26 and the second side panel top flap 42. The tear line portion 44*a* of the fold line 44 joining the first side panel top flap 38 to the first side panel 22 extends outwardly from the lower tear line 106 and the tear line 44*a* joining the second side top flap 42 to the second side panel 26 extends outwardly from the lower tear line 106 in the second panel 26 as shown in FIG. 1. The two tear lines 104, 106 may be discontinuous at the fold line 30 joining the first side panel 22 to the front panel 24 thereby separating the tear strip 102 into two sections, one of which extends in the first side panel 22 and the other of which extends in the front panel 24 and second side panel 26.

The non-print side 18 of the carton blank 10 of FIG. 1 is shown in FIG. 2A with the top wedge face flap 46 folded downwardly in face-to-face juxtaposition with the top wedge cap flap 48 (not shown in FIG. 2A) and the upper portion of the front panel 24. Similarly, the bottom wedge face flap 68 is folded upwardly to be in face-to-face juxtaposition with the bottom wedge base flap 70 (not shown in FIG. 2A) and the lower portion of the back panel 20. With the wedge face flaps 46, 68 in this position, the fold line 76 joining the bottom wedge positioning flap 74 to the bottom wedge face flap 68 is aligned with the fold line 80 joining the back panel side glue flap 78 to the back panel 20. Similarly, the fold line 54 joining the top wedge positioning flap 52 to the top wedge face flap 46 is aligned with the fold line 32 between the front panel 24 and the second side panel 26 as shown in FIG. 2A.

The process of folding the carton blank 10 into the erected carton 12 continues with respect to FIG. 2B in which the bottom wedge retention flap 84 is folded about fold line 86 onto the back panel side glue flap 78 as shown in FIG. 2B. The edge 90 of the bottom wedge retention flap 84 is angled relative to the fold line 76 joining the bottom wedge positioning flap 74 and the bottom wedge face flap 68. The bottom wedge retention flap 84 and the edge portion 90 covers a portion of the bottom wedge positioning flap 74 as shown in FIG. 2B.

Additionally, the second side panel side glue flap 92 and the top wedge retention flap 98 are folded about the fold line 94 to be in face-to-face juxtaposition with the second side panel 26 as shown in FIG. 2B. The tear line 100 between the top wedge retention flap 98 and the second side panel side glue flap 92 is aligned with the lower tear line 106 in the second side panel 26. Additionally, the top wedge retention flap 98 overlaps a portion of the top wedge positioning flap 52 as shown in FIG. 2B. The respective deposits of adhesive 88 adhere the upper portion of the bottom wedge retention flap 84 to the back panel side glue flap 78 and the second side panel side glue flap 92 is adhered by the deposits of adhesive 96 to the second side panel 26. The top wedge retention flap 98 is not adhered to the second side panel 26 and the lower portion of the bottom wedge retention flap 84 is not adhered to the back panel side glue flap 78 for reasons to be detailed later herein. The bottom wedge positioning flap 74 is free to slide between the bottom wedge retention flap 84 and the back panel side glue flap 78. Similarly, the top wedge positioning flap 52 is free to slide between the top wedge retention flap 98 and the second side panel 26.

Figure 3B:
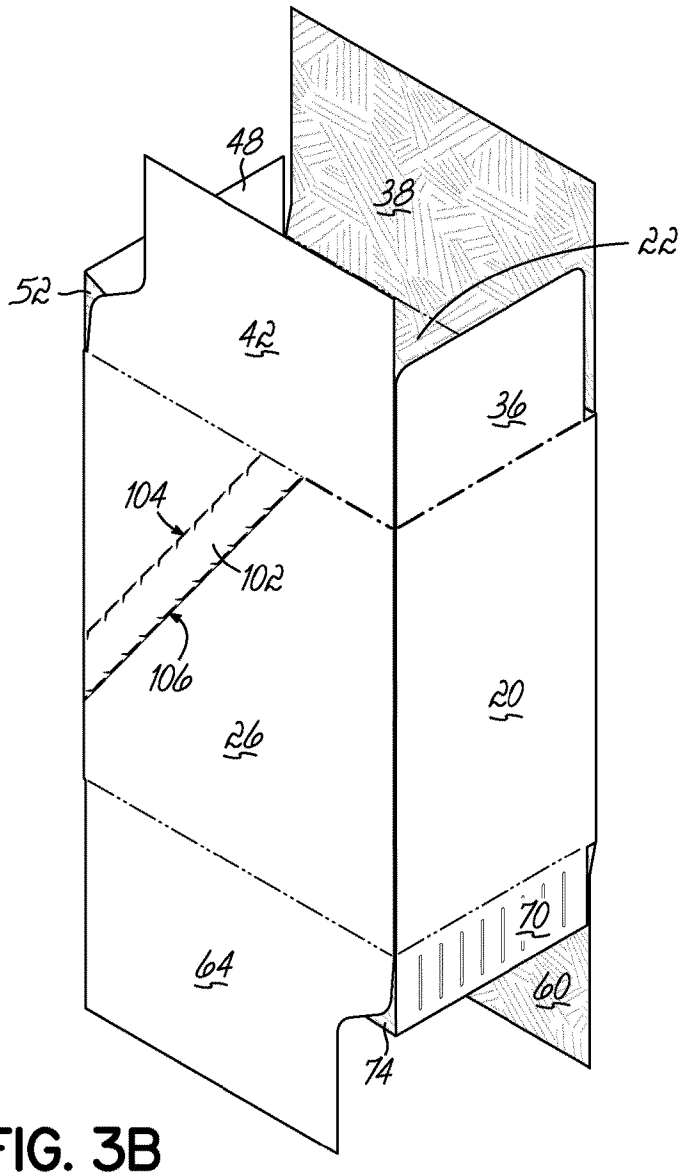
FIGS. 3A and 3B are sequential perspective views of the carton blank of FIG. 2B being folded into a tubular configuration according to one embodiment of this invention.
Figure 3A:
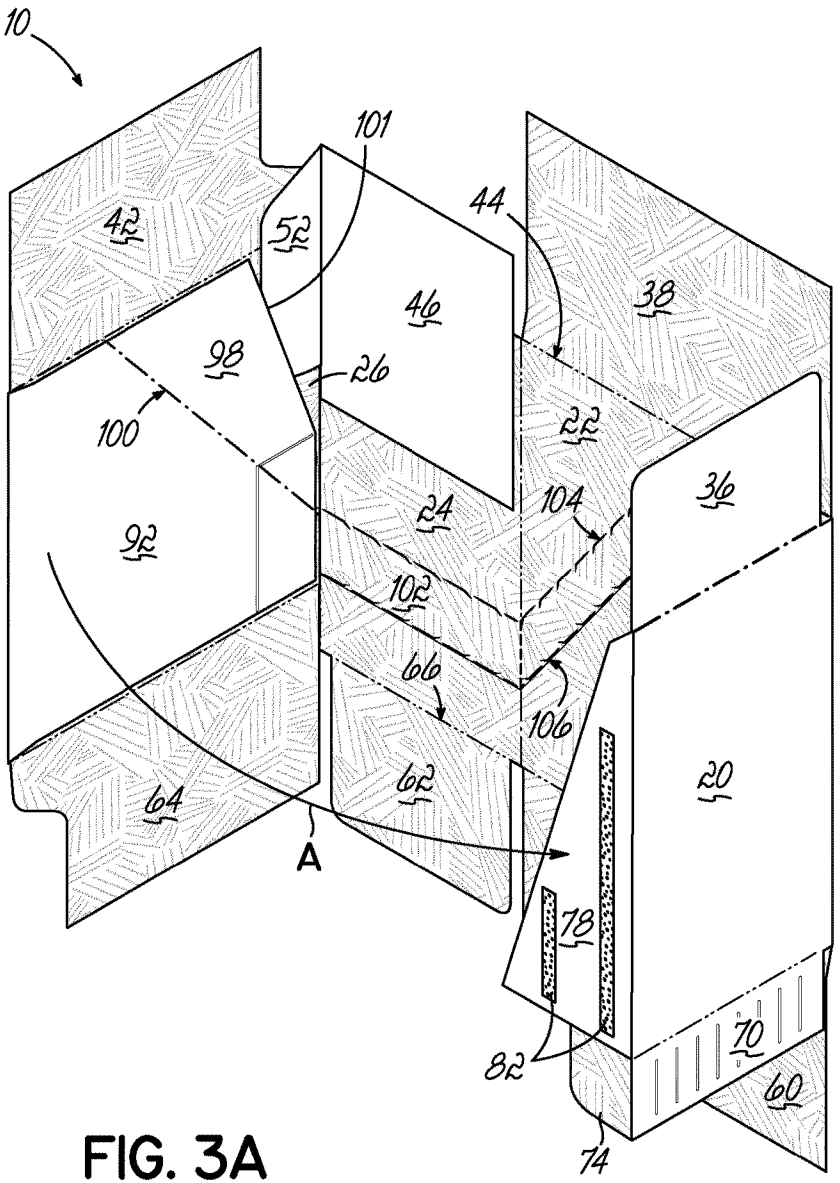

The process of erecting the carton 12 continues as shown in FIGS. 3A and 3B which results in the carton blank 10 being formed into a tubular configuration with the top and bottom open as shown in FIG. 3B. Specifically, the second side panel side glue flap 92 is folded in the direction of arrow A to be adhered by the deposits of adhesive 82 to the print side 16 of the carton blank 10 at the back panel side glue flap 78 as shown in FIG. 3A. The juncture along fold line 94 between the second side panel 26 and the second side panel side glue flap 92 is aligned with the juncture along fold line 80 between the back panel 20 and the back panel side glue flap 78 as shown in FIG. 3B. The carton blank 10 formed into a tubular configuration as shown in FIG. 3B allows for the first and second side panels 22, 26 to be generally parallel and spaced from one another and the front and back panels 24, 20 to likewise be parallel and spaced from one another. The carton blank 10 in the tubular configuration of FIG. 3B may be collapsed as necessary for shipping and ultimate filling with products 14 as is necessary.

One aspect of the carton 12 according to various embodiments of this invention is a top structure in the shape of a wedge 110 and a bottom structure in the shape of a wedge 112 formed within the interior volume of the carton 12. The top and bottom wedges 110, 112 are shown in cross section in FIG. 6. The top and bottom wedges 110, 112 position the products 14 within the carton 12 in a canted or slanted orientation for enhanced viewing of the products 14 once the carton 12 is in the display stand configuration as will be described later herein. The orientation of the products 14 in the carton is oblique relative to the top and bottom panels and relative to the front and back panels 24, 20. The wedges 110, 112 cooperate to maintain the products 14 in a canted orientation during shipping so that when the tear strips 102 and shipping portion of the carton 12 are removed for use of the carton 12 as a display stand 114, the products are neatly arranged.

Figure 4B:
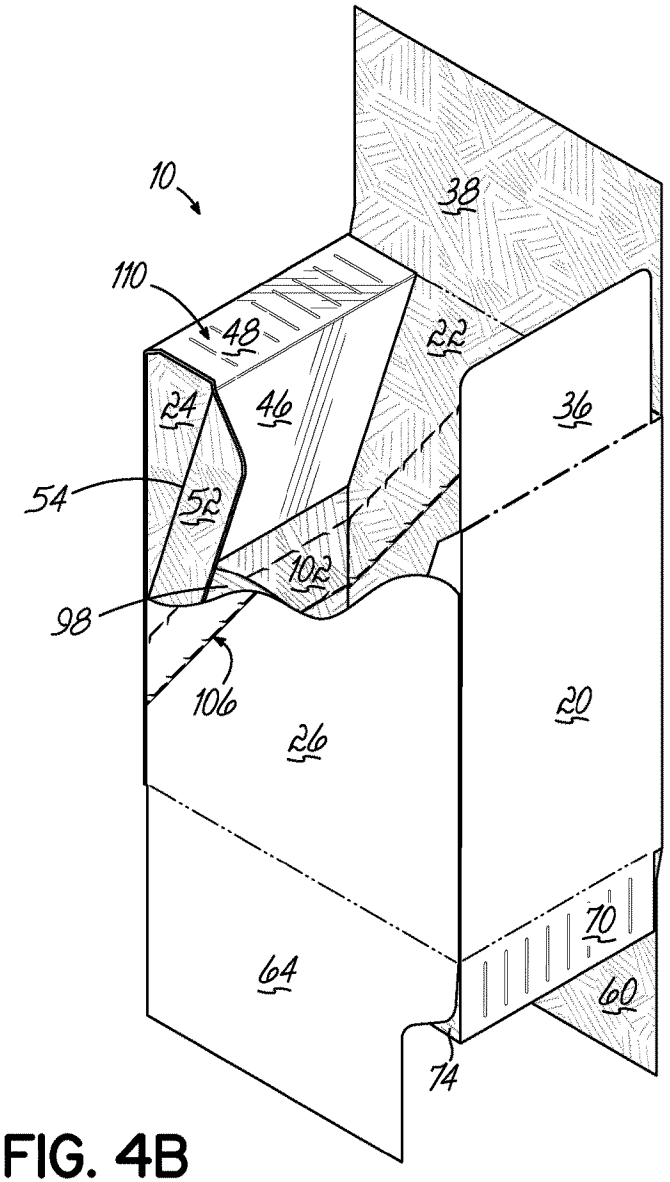
FIGS. 4A thru 4D are sequential perspective views of the carton blank in the tubular configuration of FIG. 3B being folded into an erected carton with selected panels and flaps shown broken away to reveal details of the folding method according to this embodiment of the invention.
Figure 4A:
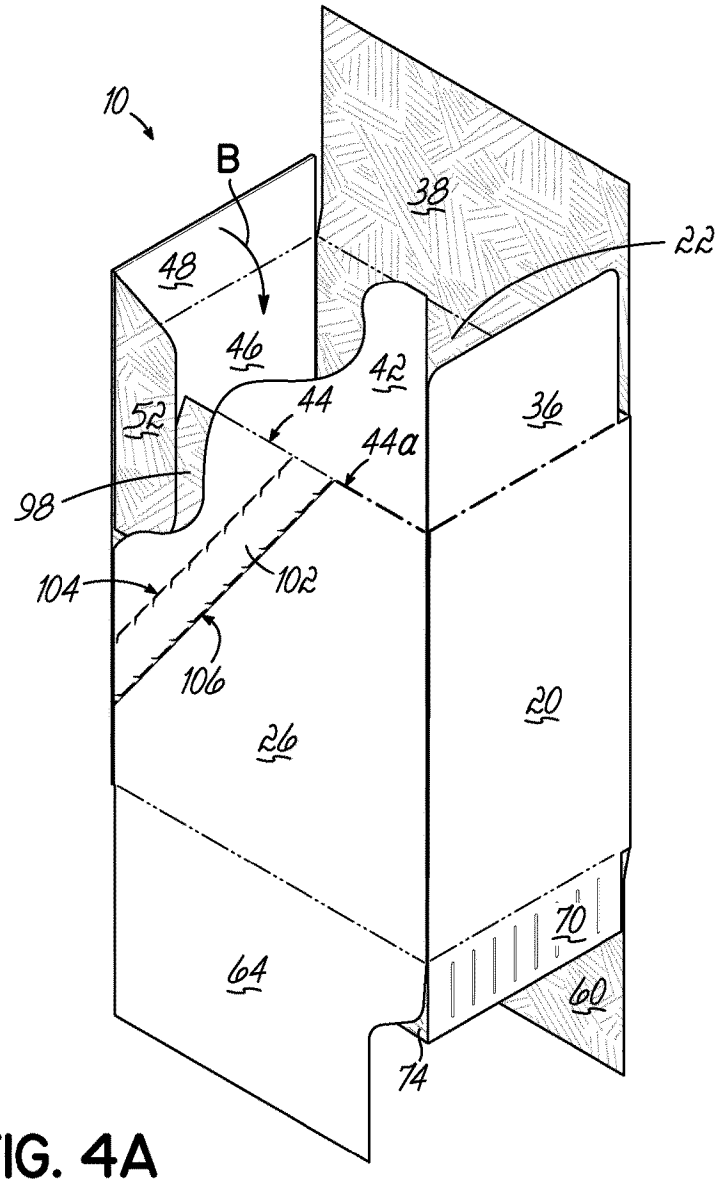

The process of erecting the top and bottom wedges 110, 112 within the carton 12 is shown in FIGS. 4A-4D. As shown in FIG. 4A, the top wedge cap flap 48 is folded in the direction of arrow B toward the interior of the carton blank 10 formed into the tubular configuration. Folding the top wedge cap flap 48 in the direction of arrow B and away from the front panel 24 simultaneously forces the top wedge positioning flap 52 to slide downwardly between the second side panel 26 and the top wedge retention flap 98 until the juncture along fold line 54 between the top wedge face flap 46 and the top wedge positioning flap 52 engages the beveled edge 101 of the top wedge retention flap 98 thereby limiting the downward movement of the top wedge cap flap 48 so that it is generally perpendicular to the front panel 24 as shown in FIG. 4B.

Figure 4D:
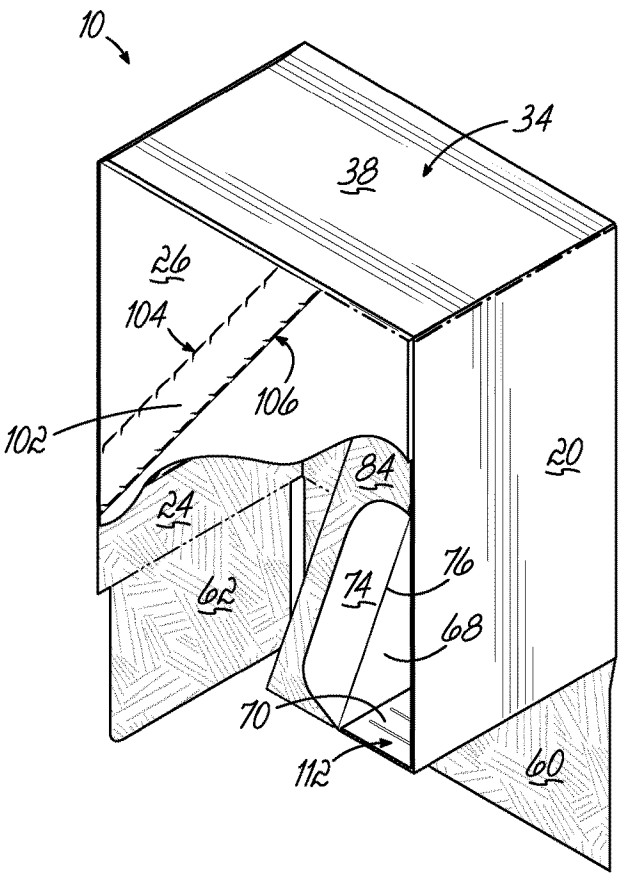
Figure 4C:
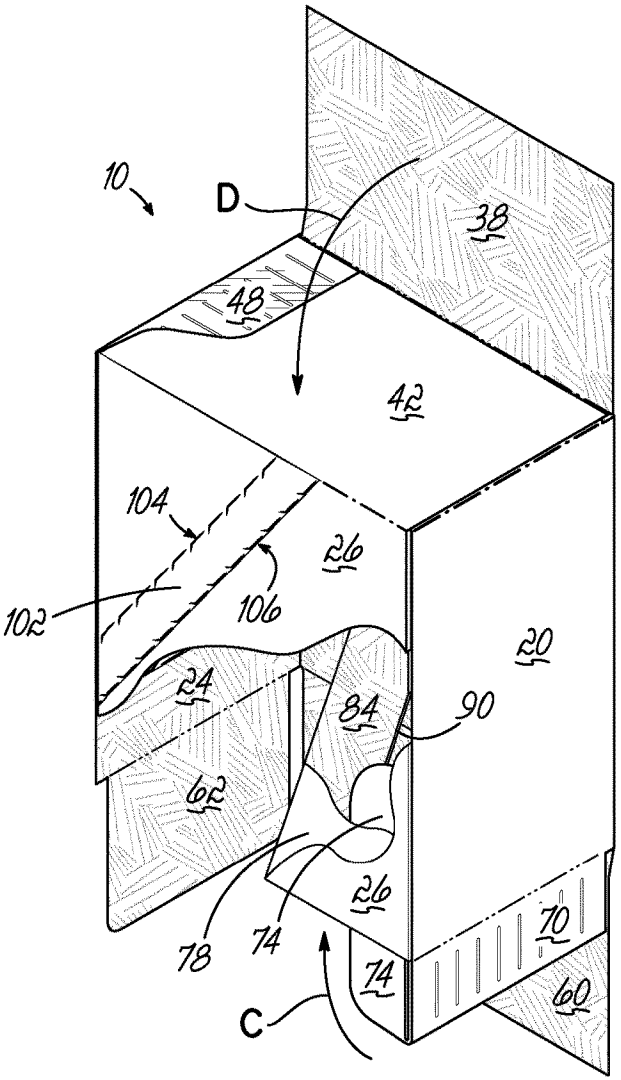

Similarly, as shown in FIGS. 4C and 4D, the bottom wedge 112 is erected by folding the bottom wedge base flap 70 in the direction of arrow C away from the bottom wedge face flap 68 which slides along the non-print side 18 of the back panel 20. This movement advances the bottom wedge positioning flap 74 to slide between the back panel side glue flap 78 and the bottom wedge retention flap 84 until the fold line 76 at the juncture between the bottom wedge face flap 68 and the bottom wedge positioning flap 74 engages the edge 90 of the bottom wedge retention flap 84 thereby limiting further movement of the bottom wedge face flap 68 so that the bottom wedge base flap 70 is generally perpendicular to the back panel 20 as shown in FIG. 4D. The first side panel top flap 38 and second side panel top flap 42 are all folded onto the top wedge cap flap 48 to thereby form the top 34 0f the carton 12 as shown by arrow D in FIG. 4C. Appropriate adhesive is utilized to secure the first and second side panel top flaps 40, 42 into position as shown in FIG. 4D.

Similarly, the first side bottom and the second side bottom flaps 60, 64 are folded onto the bottom wedge base flap 70 to form the bottom 56 of the carton 12 and appropriate adhesive may be utilized to secure the first and second side bottom flaps 60, 64 into position as will be well known by one of ordinary skill in the art.

Figure 6:
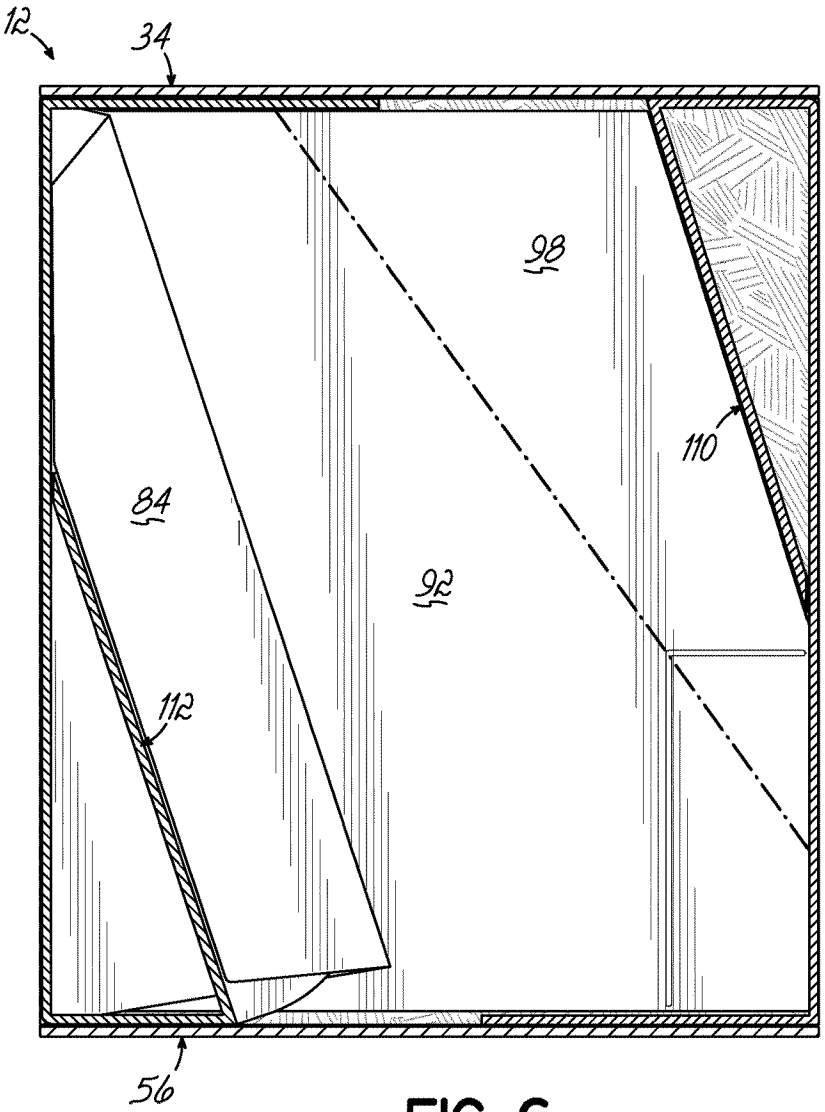
FIG. 6 is a cross-sectional view of the carton of FIG. 5 taken along line 6-6 of FIG. 5.

The carton 12 according to one embodiment of this invention as shown in FIG. 5 is adapted to contain products 14 therein in a canted or slanted orientation due to the wedges 110, 112 as shown in the cross-sectional view of FIG. 6. The package, including the carton 12 and products 14, of FIGS. 5 and 6 is suitable for shipping and storage as will be appreciated by one of ordinary skill in the art. Once the package arrives at a retail location or other destination, the carton 12 may be reconfigured into a display stand 114 as shown in FIG. 8. The display stand 114 is achieved by removal of the upper shipping portion 116 of the carton 12 as shown in FIG. 8. The removal is accomplished by tearing the tear strip 102 according to one embodiment of this invention as shown by arrows E and F in FIG. 7. The portion of the tear strip 102 extending through the first side panel 22 is torn upwardly (arrow E) at an angle through the first side panel 22 until the torn tear strip reaches the top 34 0f the carton 12. The tear line 86 is also torn as the tear line 106 is torn in the first side panel 22. Continued tearing results in separation of the first side panel 22 from the first side panel top flap 38 as well as the back panel top flap 36 due to the combined fold and tear line extending laterally outward from the tear strip 102 in the carton 12as shown in FIG. 1.

Figure 7:
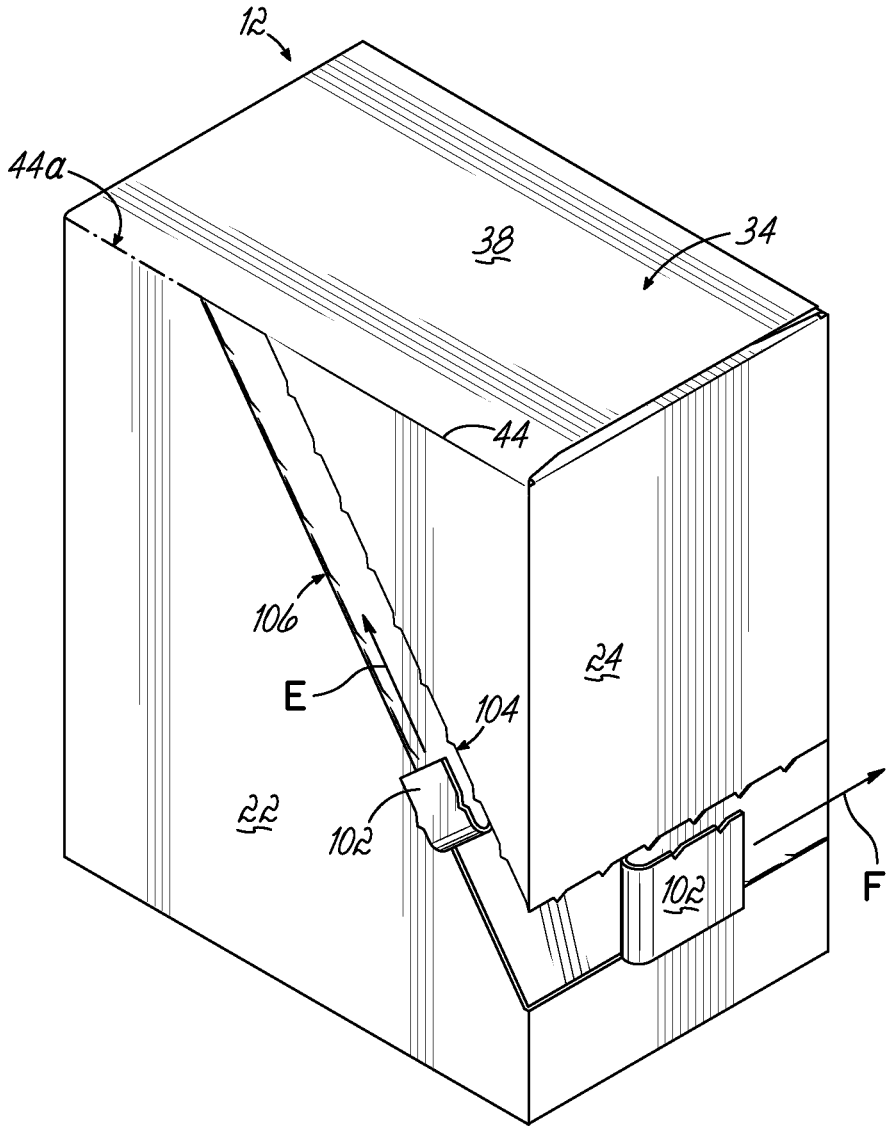
FIG. 7 is a view similar to FIG. 5 with tear strips on the carton being torn.
Figure 8:
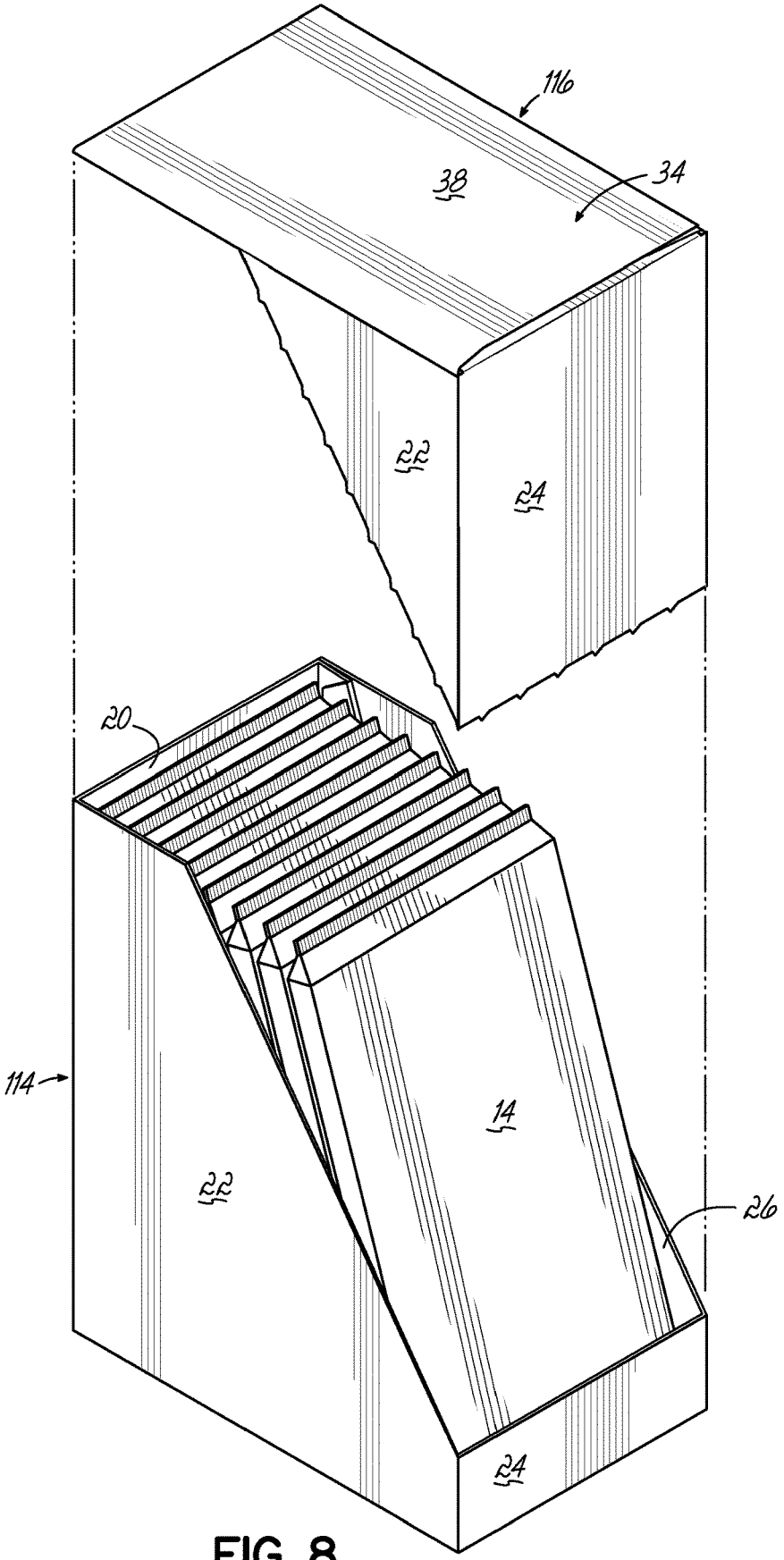
FIG. 8 is a view of the carton of FIG. 6 with the tear strips and a shipping portion of the carton removed to expose a display stand portion and the contents of the carton.

The tear strip 102 is also torn laterally across the front panel 24 as shown by arrow F in FIG. 7 until this portion of the tear strip 102 reaches the second side panel 26. The tear strip 102 then continues to be torn upwardly at an angle through the second side panel 26 until it reaches the second side panel top flap 42. Continued tearing separates the second side panel top flap 42 from the second side panel 26 thereby removing the entirety of the top 34 0f the carton 12 as well as portions of the first and second side panels 22, 26 and the front panel 24 from the carton 12 leaving the display stand portion 114 of the carton 12 containing the products 14 at a canted angle as shown in FIG. 8. Removal of one or more products 14 from the display stand 114 is easily achieved by a user or retail consumer. Any products 14 remaining in the display stand 114 are positioned in a canted or slanted angle due to the bottom wedge 112 remaining in the display stand 114.

From the above disclosure of the general principles of this invention and the preceding detailed description of at least one embodiment, those skilled in the art will readily comprehend the various modifications to which this invention is susceptible. Therefore, I desire to be limited only by the scope of the following claims and equivalents thereof.

I claim:

1. A carton comprising:

a plurality of panels combining to define an interior volume of the carton in which a plurality of similarly sized and shaped products are arranged, the plurality of panels including a top panel, a bottom panel, a front panel and a back panel;

a bottom structure and a top structure each within the interior volume, the bottom structure being in contact with both the back panel and the bottom panel, the top structure being in contact with both the front panel and the top panel, the top and bottom structures each positioning the plurality of products within the interior volume of the carton at an orientation; and a removable portion which, when removed from a remainder of the carton, exposes the plurality of products at the orientation for viewing and retrieval.

2. The carton of claim 1 further comprising:

a tear line joining the removable portion to the remainder of the carton such that when the tear line is torn the removable portion separates from the remainder of the carton.

3. The carton of claim 1 further comprising:

a pair of spaced, generally parallel side panels each extending from the top panel to the bottom panel and from the front panel to the back panel.

4. The carton of claim 1 wherein the removable portion further comprises at least portions of each of the top and front panels.

5. The carton of claim 1 wherein the removable portion further comprises the top structure.

6. The carton of claim 1 wherein the top and bottom structures each further comprise a flap orientated generally parallel to the orientation of the plurality of products.

7. The carton of claim 1 wherein the top and bottom structures further comprise a top wedge and a bottom wedge, respectively.

8. The carton of claim 1 wherein the carton is formed from an integral blank.

9. A carton comprising:

a plurality of panels combining to define an interior volume of the carton in which a plurality of similarly sized and shaped products are arranged, the plurality of panels including a top panel, a bottom panel, a front panel and a back panel;

a bottom structure and a top structure each within the interior volume, the bottom structure being positioned proximate a juncture of the back panel and the bottom panel, the top structure being positioned proximate a juncture of the front panel and the top panel, the top and bottom structures each positioning the plurality of products within the interior volume of the carton at an orientation; and a removable portion which, when removed from a remainder of the carton, exposes the plurality of products at the orientation for viewing and retrieval;

wherein the orientation of the plurality of products is oblique relative to the bottom panel.

10. A carton comprising:

a plurality of panels combining to define an interior volume of the carton in which a plurality of similarly sized and shaped products are arranged, the plurality of panels including a top panel, a bottom panel, a front panel and a back panel;

a bottom structure and a top structure each within the interior volume, the bottom structure being positioned proximate a juncture of the back panel and the bottom panel, the top structure being positioned proximate a juncture of the front panel and the top panel, the top and bottom structures each positioning the plurality of products within the interior volume of the carton at an orientation; and a removable portion which, when removed from a remainder of the carton, exposes the plurality of products at the orientation for viewing and retrieval;

wherein the orientation of the plurality of products is oblique relative to the back panel.

11. A carton comprising:

a plurality of panels combining to define an interior volume of the carton in which a plurality of similarly sized and shaped products are arranged, the plurality of panels including a top panel, a bottom panel, a front panel and a back panel;

a bottom structure and a top structure each within the interior volume, the bottom structure being positioned proximate a juncture of the back panel and the bottom panel, the top structure being positioned proximate a juncture of the front panel and the top panel, the top and bottom structures each positioning the plurality of products within the interior volume of the carton at an orientation which is oblique relative to the bottom panel and the back panel;

a removable portion which, when removed from a remainder of the carton, exposes the plurality of products at the orientation for viewing and retrieval;

wherein the removable portion further comprises at least portions of each of the top and front panels and the top structure; and a tear line joining the removable portion to the remainder of the carton such that when the tear line is torn the removable portion separates from the remainder of the carton.

12. The carton of claim 11 further comprising:

a pair of spaced, generally parallel side panels each extending from the top panel to the bottom panel and from the front panel to the back panel.

13. The carton of claim 11 wherein the top and bottom structures each further comprise a flap orientated generally parallel to the orientation of the plurality of products.

14. The carton of claim 11 wherein the top and bottom structures further comprise a top wedge and a bottom wedge, respectively.

15. The carton of claim 11 wherein the carton is formed from an integral blank.

16. A blank for forming a carton containing a plurality of products, the blank comprising:

a plurality of serially connected panels including a front panel and a back panel;

a plurality of top flaps foldably coupled to at least selected ones of the serially connected panels, the plurality of top flaps combining to form a top panel of the carton when formed from the blank;

a plurality of bottom flaps foldably coupled to at least selected ones of the serially connected panels, the plurality of bottom flaps combining to form a bottom panel of the carton when formed from the blank;

a top structure coupled to at least one of the plurality of top flaps;

a bottom structure coupled to at least one of the plurality of bottom flaps;

wherein the bottom structure and the top structure are each positioned within an interior volume of the carton when formed from the blank, the bottom structure being positioned proximate a juncture of the back panel and the bottom panel, the top structure being positioned proximate a juncture of the front panel and the top panel, the top and bottom structures each positioning the plurality of products within the interior volume of the carton at an orientation when the carton is formed from the blank and the plurality of products positioned therein;

a removable portion which, when removed from the carton formed from the blank, exposes the plurality of products at the orientation for viewing and retrieval from a remainder of the carton.

17. The blank of claim 16 further comprising:

a tear line joining the removable portion to the remainder of the blank such that when the carton is formed from the blank and the tear line is torn, the removable portion separates from the remainder of the carton.

18. The blank of claim 16 wherein the plurality of panels further comprises:

a pair of spaced side panels which each extend from the top panel to the bottom panel and from the front panel to the back panel when the carton is formed from the blank.

19. The blank of claim 16 wherein the removable portion further comprises at least portions of the plurality of top flaps and the front panel.

20. The blank of claim 16 wherein the removable portion further comprises the top structure.

21. The blank of claim 16 wherein the top and bottom structures each further comprise a flap orientated generally parallel to the orientation of the plurality of products when the carton is formed from the blank.

22. The blank claim 16 wherein the orientation of the plurality of products is oblique relative to at least one of the bottom panel and the back panel when the carton is formed from the blank.

23. The blank of claim 16 wherein the blank is an integral blank.

* * * * *